US005409228A

United States Patent [19]

Botsch

[11] Patent Number: 5,409,228

[45] Date of Patent: Apr. 25, 1995

[54] ALIGNMENT SYSTEM DEVICE FOR EXISTING PUTTERS

[76] Inventor: Robert E. Botsch, 120 Gyles Rd., Aiken, S.C. 29830

[21] Appl. No.: 230,633

[22] Filed: Apr. 21, 1994

[51] Int. Cl.[6] ..... A63B 69/36

[52] U.S. Cl. ..... 273/164.2; 273/194 A

[58] Field of Search ..... 273/186.2, 187.4, 194 A, 273/163 R, 164.1, 164.2, 187.3, 163 A, DIG. 30

[56] References Cited

U.S. PATENT DOCUMENTS

| | | | |
|---|---|---|---|
| 3,262,705 | 7/1966 | Nunziato | 273/163 |
| 3,298,693 | 1/1967 | Eisenberg | 273/163 |
| 3,343,839 | 9/1967 | Borah | 273/80.2 |
| 3,667,761 | 6/1972 | Palotsee | 273/186 A |
| 3,788,646 | 1/1974 | Rawson | 273/187.3 |
| 3,884,477 | 5/1975 | Bianco | 273/183 D |
| 4,030,766 | 6/1977 | Derr | 273/163 R |
| 4,032,156 | 6/1977 | Clarke | 273/164 |
| 4,136,877 | 1/1979 | Antonious | 273/164 |
| 4,167,268 | 9/1979 | Lorang | 273/163 A |
| 4,340,229 | 7/1982 | Stuff, Jr. | 273/164 |
| 4,688,798 | 8/1987 | Pelz | 273/164 |
| 4,749,196 | 6/1988 | Podgor | 273/164 |
| 4,809,981 | 3/1989 | Doran et al. | 273/164 |
| 4,872,683 | 10/1989 | Doran et al. | 273/164 |
| 4,928,971 | 5/1990 | Soles, Jr. | 273/164 |
| 5,133,556 | 7/1992 | Karasavas | 273/187.3 |

OTHER PUBLICATIONS

Golf Magazine, Marketplace, Jun. 1992, p. 113, "Dougle Image".

Golf Digest, Reviews, May 1992, p. 36, "Tru Align".

*Primary Examiner*—George J. Marlo

*Attorney, Agent, or Firm*—Michael E. Mauney

[57] ABSTRACT

A visual alignment device made of any appropriate high impact material that may be readily attached as a temporary training device or bonded as an integral part of many existing putter type golf clubs that assists the player in visualizing the putting line, in positioning his eyes over the putting line, and in properly aligning the putter head with the ball to be struck and in maintaining that alignment throughout the stroke. The top half of the device consists of a hollow hemisphere of the same diameter as a golf ball containing a sighting slot running substantially across it from the front to the rear and a number of small holes that simulate dimples in the ball and also allow light to enter the device. The base of the device has features which properly position the device on putter heads and has a brightly colored raised reference line bisecting the interior of the base extending from the front to the rear so that when the device is properly fixed upon a putter head and when the putter is properly aligned with the ball to be struck, the reference line will point to the center of the ball to be struck along the putting line and the player's eyes will be directly over the putting line.

16 Claims, 4 Drawing Sheets

ALIGNMENT SYSTEM DEVICE FOR EXISTING PUTTERS

BACKGROUND AND SUMMARY OF INVENTION

The present invention relates to an alignment system that may be attached either temporarily or permanently to many existing putter golf clubs that assists the player in positioning his eyes directly over the putting line, which on a straight putt is the line extending from the center of the hole through and behind the center of the ball to be struck, in visualizing that putting line between the center of the hole through the center of the ball to be struck, in properly aligning the putter head on that line behind the ball to be struck, in maintaining proper alignment of the putter head throughout the stroke, and in seeing the path of the putter head as it is swung back and through the ball so that it is easier to swing the putter head along that putting line.

Although the golfer generally carries fourteen clubs, the putter is probably the most important club because no other club is used to execute as many strokes as the putter. In a par round of golf it is assumed that about half of the strokes will be with the putter. Thus, the ability to properly execute the putting stroke is of vital importance for successful golf. Executing a proper putting stroke presents several challenges to the player. First, the player must be able to visualize the correct putting line between the the hole and the ball to be struck. On putts with no break to either the left or right, the putting line is a straight line that runs from the center of the hole through the center of the ball to be struck. The path of the ball coincides with the putting line. On putts that will break to either the left or right because of either slope in the green or the grain of the grass, the player must visualize a straight putting line that is aimed at a point that is to the left or right of the hole by the same amount of distance that the putt will break. In this case, the path of the ball will curve off the putting line soon after the ball leaves the face of the putter head and roll to the hole on a curved path if the player made the correct estimates and executes the stroke properly for those estimates. Second, the player must strike the ball with the correct amount of force at or close to the center of gravity on the face of the putter head, which is often called the "sweet spot." Failure to strike the ball at the sweet spot may result in an otherwise successful putt failing to reach the hole. There is an interactive effect between the first and second challenges on breaking putts. The greater the force the player applies to the ball, the less the ball will curve away from the putting line over a given distance. Third, the player must align the face of the putter head so that it is perpendicular to the line of the putt at the point of impact. Failure to do so will impart a side spin on the ball so that it curves off the intended path. Finally, the player must keep the putter head traveling almost precisely along the intended line of the putt as the putter head approaches the ball and during impact with the ball. Failure to do so causes the ball to begin traveling off the putting line as soon as it is struck—what players call pushing or pulling the putt—and also imparts some unwanted side spin. The player who can constantly meet each and every one of these four challenges will hole more putts than the player who frequently falls short on even one of them. The present invention is designed to assist in consistently meeting important components of all four of these critical challenges.

Over the long history of golf, the design of putters has evolved to assist the player in executing a more consistent stroke. One of the most popular putters utilizes heel and toe weighting, thereby enlarging the angular momentum, giving the effect of a larger sweet spot. With a larger sweet spot, slight variations from the center of the sweet spot in where the ball is struck on the face of the putter reduces the difference in how far the ball rolls. The heel and toe weighting is often achieved by creating a cavity in the back of the putter head and massing most of the weight in the toe, the end of the putter head farthest away from the player, and the heel, the end of the putter head closest to the player. Another popular design, the mallet head putter, is larger in size and sometimes heavier in weight. The advantage of having a larger putter head, especially in the measurement from the face that strikes the ball to the following rear edge, is that longer reference lines or stripes can be added to the top of the putter head to assist the player in properly orienting the putter head in position with respect to the ball and the line of the putt. Some of the heel and toe weighting effect can still be achieved by making the interior of the putter head hollow with internal weighting in the heel and toe. The sometimes heavier weighting of mallet head putters assists those players who have trouble in striking the ball with enough force to roll it all the way to the hole.

SUMMARY OF THE INVENTION

Accordingly, it is the object of the present invention to provide an improved alignment system that may be temporarily attached for practice or permanently attached for play to existing putters such as the heel and toe weighted cavity backed putter and the mallet head putter to assist the player in meeting four critical challenges inherent in executing the putting stroke: visualizing the putting line from the hole on straight putts or some imaginary point beside the hole on breaking putts through the ball to be struck; striking the ball at the sweet spot on the face of the putter head; aligning the face of the putter head perpendicular to the putting line and maintaining that alignment through impact with the ball; and keeping the putter head traveling along the putting line during the stroke.

The proposed invention assists the player by helping him ensure that his eyes are consistently directly over the putting line as it extends from the center of the hole or some point beside the hole on breaking putts through the center of ball to be struck. Consistent placement of the eyes over the putting line reduces the variation in how the player visually perceives the putting line. Proper placement of the eyes over the putting line is achieved by a housing having a hollow top hemisphere and a cylindrical lower half with a sighting slot in the hollow top hemisphere. The sighting slot allows the player to see a reference line on the inside base of the housing that will evenly split the sighting slot when the club is properly grounded and when the player's eyes are directly over the putting line. When this sighting position is achieved, the reference line coincides with the putting line.

In order for the proposed device to function properly so that the player's eyes are directly over the putting line, the putter head must be properly grounded so that the sweet spot on the face of the club is directly above the point at which the sole of the clubhead makes contact with the putting surface. On many existing putters the sole of the clubhead is rounded so that properly grounding the club must be achieved through practise. On some putters with flat soles properly grounding the putter head is ensured when the putter head is placed flat against the putting surface. The proposed device works with either type of putter as long as each is properly grounded.

The proposed invention assists the player by allowing him to line up three spherical objects on the putting line when it is a straight putt: the hole, the ball to be struck, and the hemispherical top of the proposed invention, which appears as a sphere approximately the same size, shape and color of a golf ball when viewed from above-,or from above and slightly to the rear. On breaking putts, the proposed invention assists the player in seeing how far the hole is off the putting line defined by lining up two similar spherical objects: the ball to be struck and the hemispherical top of the proposed invention, which appears as a sphere approximately the same size, shape, and color of a golf ball when viewed from above, or from above and slightly to the rear.

The proposed invention assists the player by allowing the player to view the line formed by the three spherical objects on straight putts or two objects on breaking putts from slightly behind the head of the putter while maintaining the player's eyes directly over the line as it extends through and behind the ball. It is often thought that the player should position his eyes directly over the ball to be struck. However, with this invention, the slightly to the rear yet over the putting line sighting position, as opposed to positioning the player's eyes directly over the putter head or ball, lends some of the same advantage that a marksman has in sighting a rifle from the rear.

The proposed invention assists the player in striking the ball at the sweet spot on the face of the putter head by allowing the player to see the hemispherical top of the proposed invention, which is the same diameter as the ball to be struck, appear to pass through the ball to be struck as the swing is executed. The proposed invention is attached to the putter head so that a reference line within the proposed invention, which bisects the hemispherical top when viewed from above through a sighting slot, points to the sweet spot on the face of the putter head. Therefore, when the player swings the putter head so that the proposed invention passes through the ball, the ball will be struck at the sweet spot on the face of the putter.

The proposed invention assists the player in aligning the face of the putter head in a position that is perpendicular to the putting line by providing a reference line which is perpendicular to the face of the putter head and which coincides with the putting line when it points to the center of the ball to be struck while the hemispherical top of the proposed invention is properly positioned on the putting line.

The proposed invention assists the player in maintaining the face of the putter in a position that is perpendicular to the putting line throughout the stroke once the initial alignment position is established. Any rotation of the face of the putter head away from a perpendicular position will be immediately detected as seeing the hemispherical top of the proposed invention shift off the putting line during the stroke as it moves along that line behind the ball to be struck.

The proposed invention assists the player in swinging the putter head along the putting line when the player focuses his vision on the point of intended impact between the ball and the putter head and sees with his peripheral vision the hemispherical top of the proposed invention moving along the previously established putting line as it extends behind the ball. Any deviation from the intended path of the putter head will be perceived as the hemispherical top of the proposed invention moving off the previously established putting line.

The proposed invention may be adopted to existing heel and toe weighted cavity backed putters and to mallet head type putters thereby eliminating the need to purchase a new putter. Players who are comfortable with the feel or playing characteristics of their existing putters may not have to change putters in order to gain the advantages of the proposed invention.

The proposed invention may be attached permanently using a bonding epoxy so as to become an integral part of the putter head or it may be attached as a training device using temporary attachment means such as double stick tape, or tape having miniature hooks and eyes known by the trade name "VELCRO". The proposed invention has built-in means to ensure that it can be affixed and reaffixed at the proper location on the putter head so that the player can have visual consistency each time it is used. Included in these means are a straight leading edge on the base of the proposed invention that is perpendicular to the reference line so that when the leading edge is butted up against the inside of the cavity in many heel and toe weighted cavity backed putters or lined up with the top edge of the face of a mallet type putter head the invention is properly positioned on the head of the putter. In addition, the straight leading edge also contains a small notch at its center to further assist in properly positioning the invention on the putter head.

Additional means for properly centering the proposed invention may include a line on the outside of the hemisphere and a line created by a small "V" shaped channel on the outside bottom of the base. The base of the invention has a number of holes in it to allow a bonding epoxy to seep through the holes and provide a secure grip on the proposed invention.

A number of detachable devices with extending arms or arrows extending over the ball to be struck have been proposed which aid the player in positioning his eyes over the ball. These are intended to be practice devices that are generally unsuitable for use during play. See, for example Nunziato, U.S. Pat. No. 3,262,705, Eisenberg, U.S. Pat. No. 3,298,693, Palotsee, U.S. Pat. No. 3,667,761, and Lorang, U.S. Pat. No. 4,167,268.

A number of devices have been proposed that use multiple indicia to ensure that the club is properly grounded with respect to loft and lie. See, for example Clarke, U.S. Pat. No. 4,032,156, Antonious, U.S. Pat. No. 4,136,877, Stuff, U.S. Pat. No. 4,340,229, and Soles, U.S. Pat. No. 4,928,971. Unlike the proposed invention, all of these devices emphasize placement of the player's eyes directly over the putter head while many players find it preferable to place their eyes over the putting line at a point that is slightly behind the putter head. Most of these also require that the device be built into the putter head at the time of manufacture, thereby requiring a radical redesign of the putter head and the purchase of a new club by those wishing to use these devices.

A few devices have been designed to be attached to existing putter heads. Antonious, U.S. Pat. No. 4,136,877, described an embodiment that was "in the shape of a hollow box with an open rear side" that contained indicia on the top and bottom aiding aligning proper loft and lie. Podger, U.S. Pat. No. 4,749,196, proposed a transparent disk with upper and lower reference lines, which would magnify the lower line and indicate proper alignment when the player positioned his eyes so that the upper line split the larger magnified lower line. Both these devices required the player to position his eyes directly over the device rather than slightly behind the putter head as the device proposed here. In addition, neither of these devices have the advantage of appearing as a three dimensional golf ball like sphere.

Another group of alignment aiding devices are based on the observation that players can better visualize the line between the ball and the hole if they line up the ball up with one or more like sized spheres. These devices use golf ball shaped spheres, hemispheres, or circular two dimensional simulations of golf balls built into the club head at time of manufacture. See, for example, Borah, U.S. Pat. No. 3,343,839, Bianco, U.S. Pat. No. 3,884,477, Derr, U.S. Pat. No. 4,030,766, Pelz, U.S. Pat. No. 4,688,798, Doran, U.S. Pat. No. 4,809,981, and Doran, U.S. Pat. No. 4,872,683. Unlike the invention proposed here, all of these devices require a radical redesign of the golf club and must be built into the club at the time of its manufacture thereby requiring that the player purchase an additional club. In addition, none of these devices have the advantage of providing the player a way to ensure that his eyes are over the putting line.

One device recently introduced to the market utilizes a detachable mirror on the back of the putter head which creates the image of a second sphere when the player places his eyes directly over the ball to be struck, rather than slightly behind the putter head like the device proposed here. While this device is useful in establishing proper alignment at the position of address, the image of the second sphere is lost in the mirror reflection as the stroke is executed, thereby losing the dynamic qualities of the device proposed here. Moreover, this device is built into the design of the club and therefore, unlike the device proposed here, requires that the player purchase a new club.

The invention proposed here assists the player in meeting critical aspects of successful putting through enabling him to consistently place his eyes over the putting line slightly behind the ball and putter head, in visualizing the putting line, in properly aligning the putter head with the ball and in maintaining that alignment throughout the swing, in striking the ball with the sweet spot on the face of the putter head, and in seeing that the putter head moves back and forth along the putting line behind the ball. The proposed invention allows the player to gain these combined advantages while utilizing the device as a temporarily attached practice device or as an integral part of the putter head for regular play. The proposed invention can be used in either the practice or play mode on many existing types of putters.

DETAILED DESCRIPTION OF THE DRAWINGS

Figure 1:
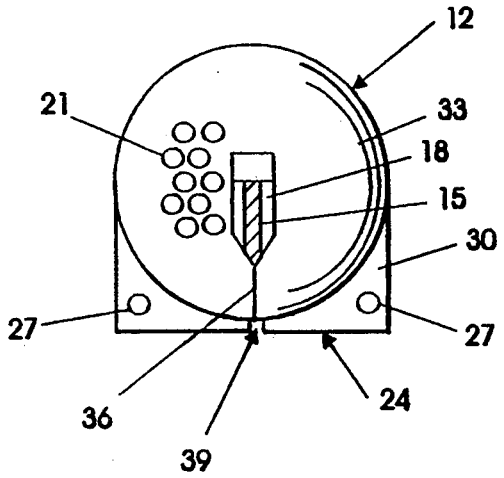
FIG. 1 is a top view of the present invention.
Figure 5:
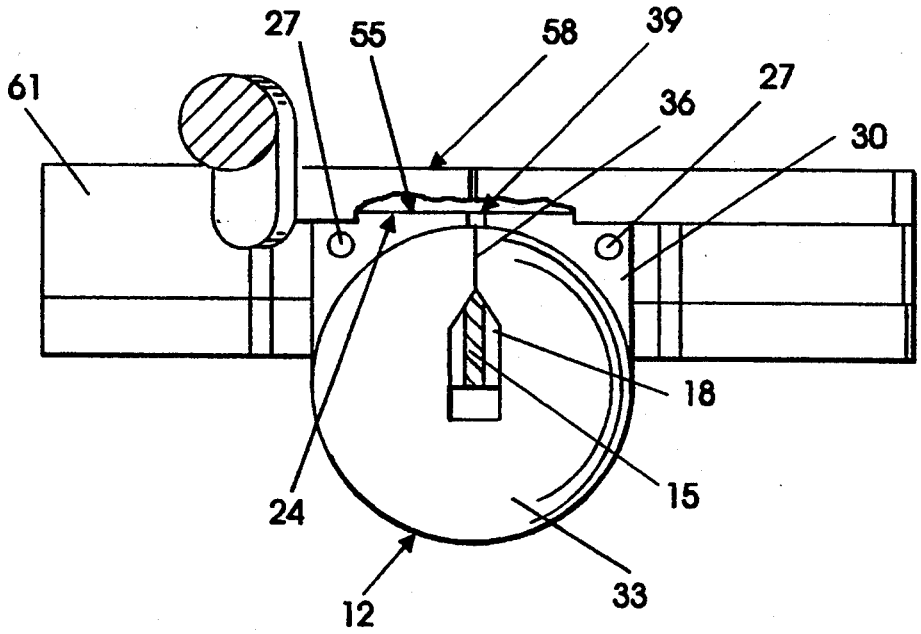
FIG. 5 is a top view of the present invention either temporarily attached or permanently mounted to a heel and toe weighted cavity backed type putter club with part of the flange on the top of the cavity area cut away so that one can view the straight leading edge of the base of proposed invention butted against the front inside edge of the cavity.
Figure 6:
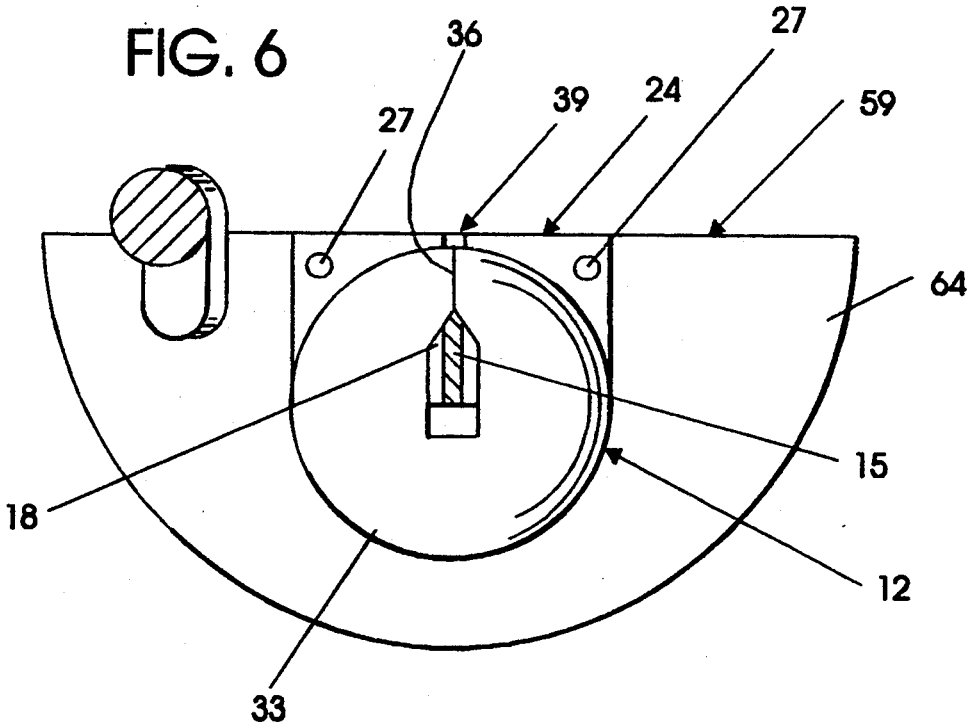
FIG. 6 is a top view of the present invention either temporarily mounted with double stick tape or permanently mounted with epoxy to a mallet type putter.

As shown in FIG. 1, a top view of the proposed invention 12, the preferred embodiment of the proposed invention 12 includes a reference line 15 that evenly splits the sighting slot 18 when viewed from above. The hemispherical top portion 33 of the proposed invention 12 appears as a golf ball from the player's point of view. A pattern of small holes 21 serve a dual purpose of allowing light to enter the proposed invention 12 and also simulate the dimples of a golf ball. The leading edge 24 of the base 30 is perpendicular to the reference line 15. The straight leading edge 24 of the base 30 extends about 0.0625 inches beyond the hemispherical section 33 of the proposed invention 12. The leading edge 24 also contains a square notch 39 of about 0.0625 inches in width and depth located at the point that bisects the length of the leading edge 24 to assist in properly positioning the proposed invention 12 on the putter head 61 as shown in FIG. 5 and on putter head 64 as shown in FIG. 6. A line 36 is molded into the hemispherical top 33 of the proposed invention 12 extending between the pointed end of the sighting slot 18 and the center of the notch 39, so that when viewed from above, the line 36 is perpendicular to the leading edge 24 of the base 30. This line 36 provides additional aid in properly positioning the proposed invention 12 on putter heads 61 and 64 as shown in FIG. 5 and FIG. 6 respectively. The proposed invention 12 is preferably made of a high impact plastic that can withstand severe blows and retain its shape and be blow molded in a single piece. Alternatively, it could be blown or pressure molded as two separate pieces that are subsequently attached to each other.

Furthermore, the proposed invention 12 is preferably white in color so that it matches the color of most golf balls. Alternative embodiments may be optic yellow or other colors of golf balls.

Figure 2:
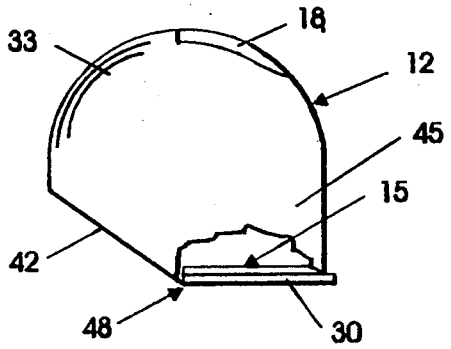
FIG. 2 is a side view of the present invention with part of the side cut away so that the interior of the device may be viewed.
Figure 3:
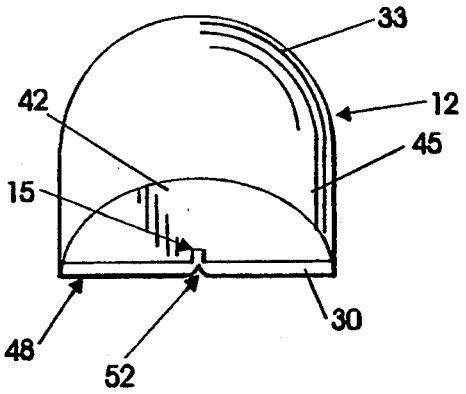
FIG. 3 is a rear view of the present invention.

As shown in the cut away section of a side view of the proposed invention 12 in FIG. 2 and through the open section 42 in a rear view of the proposed invention 12 in FIG. 3, the reference line 15 is formed by a raised surface about 0.0625 inches in width and height. The top surface of the reference line 15 is painted in some bright color such as red or orange.

As shown in FIG. 2 and FIG, 3, the bottom half 45 of the proposed invention 12 is cylindrical in shape with an open section 42 at the rear to allow additional light to enter the proposed invention to help illuminate the raised reference line 15. In an alternative embodiment in which the proposed invention 12 is manufactured in two pieces, the bottom half 45 of the proposed invention 12 may be translucent to allow the additional light to enter. The open section 42 is cut away at about a 35 degree angle to the rear from a line 48 that bisects the bottom of the cylindrically shaped lower half 45 so that the line 48 is perpendicular to the reference line 15.

Figure 4:
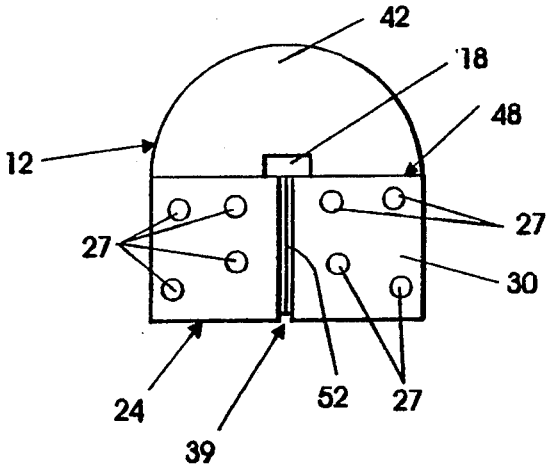
FIG. 4 is a bottom view of the present invention.

As shown in FIG. 4, a bottom view of the proposed invention 12, the base 30 contains a number of small holes 27 that allow bonding epoxy to better grip the proposed invention 12 to a heel and toe weighted cavity backed putter head 61 in FIG. 5 or the a mallet type putter head 64 in FIG. 6. The base 30 has a small "V" shaped channel 52 directly under the reference line 15 as shown in FIG. 3 that further assists in the bonding process and in properly positioning the proposed invention 12 on a heel and toe weighted cavity backed putter head 61 in FIG. 5 or the mallet type putter head 64 in FIG. 6.

As shown in FIG. 5, a top view of the proposed invention 12 properly fixed to the rear cavity of a heel and toe weighted putter head 61, the leading edge 24 butts up against the front of the inside of the cavity 55 as seen in the cut away section so that it is parallel to the face 58 of the putter head 61. The line 36 molded into the front of the hemisphere 33 from the "V" shaped point of the sighting slot 18 down to the center of the notch 39 in the leading edge 24 of the base 30 helps properly center the proposed invention 12 in the cavity 55 of the heel and toe weighted putter head 61. The proposed invention 12 may be temporarily attached as a practice device by any number of alternate means such as tape with adhesive on both sides of the tape or miniature hooks and eyes known by the trade name "VELCRO" or a magnet.

As shown in FIG. 6, a top view of the proposed invention 12 properly fixed on the top of a mallet type putter head 64, the straight leading edge 24 coincides with the top edge of the face 59 of the putter head 64.

Figure 7:
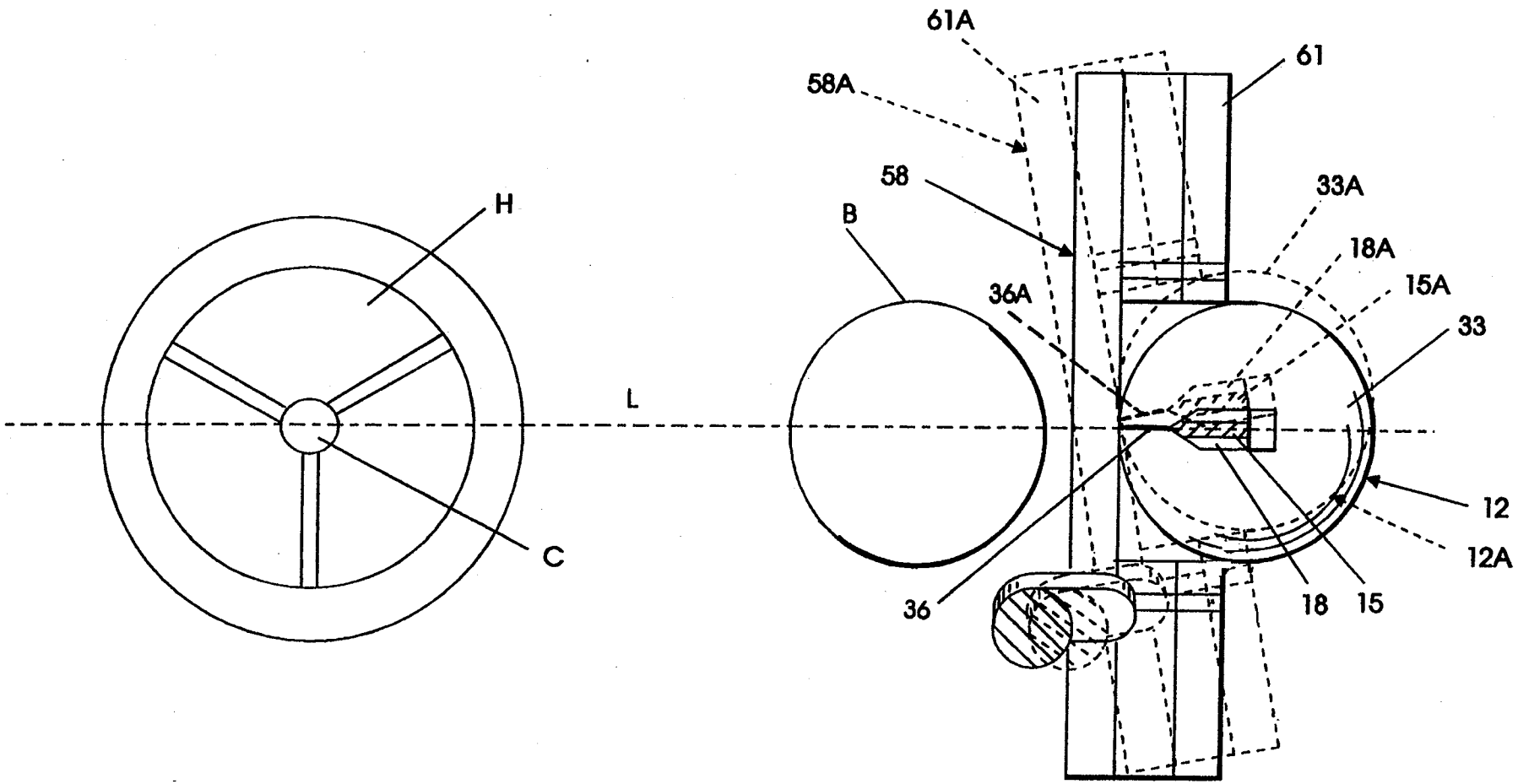
FIG. 7 illustrates the view to the player of the present invention mounted on a heel and toe weighted cavity backed putter when alignment is proper and when it is improper.

As shown in FIG. 7, correct alignment is indicated when the spherical top 33 of the proposed invention 12 forms a row with the golf ball B and the center C of the hole H and when the reference line 15 as seen through the sighting slot 18 coincides with the putting line L and points to the center of the ball B. Misalignment of the face 58A of the putter 61A with the ball B will make the spherical top 33A of the proposed invention 12A appear to deviate from the putting line L created by the center of the hole H and the center of the ball B to be struck. The reference line 36*a*, and 15A as seen from above through the sighting slot 18A no longer coincides with the putting line L and no longer points to the center of the ball B.

Figure 8:
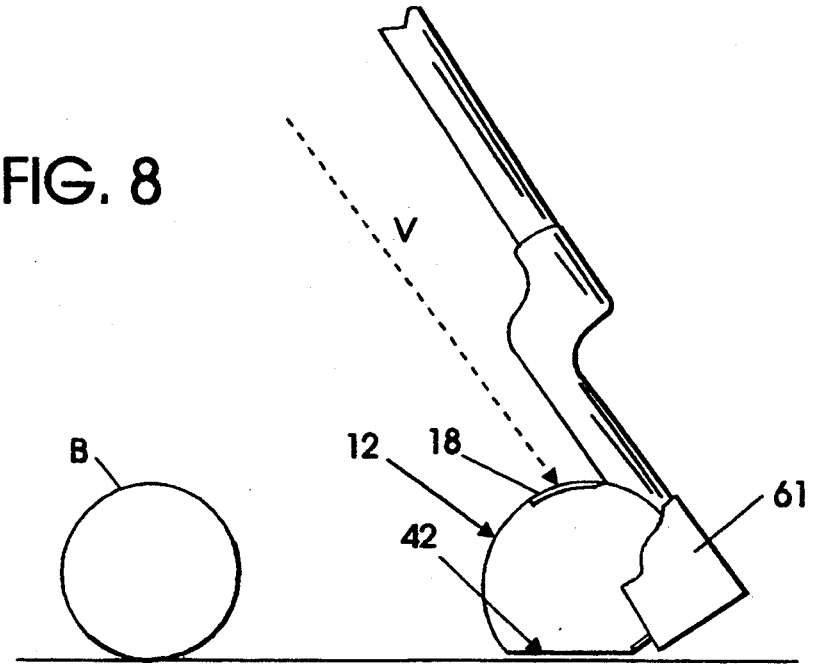
FIG. 8 is a side view of the present invention attached to a heel and toe weighted cavity backed putter when the putter is placed several inches in front of the ball to be struck in a tilted back position so that it is between the ball to be struck and the hole, as a player might wish to do in initially establishing the putting line.

As shown in FIG. 8, the open section 42 of the proposed device 12 allows the player to place the heel and toe weighted cavity backed putter head 61 in a titled back position ahead of the ball to be struck B so that he can better determine and visualize the putting line while maintaining a level relationship between the heel and toe of the putter so that the alignment means of the proposed device 12 may still be utilized as it is viewed along line V.

Figure 9:
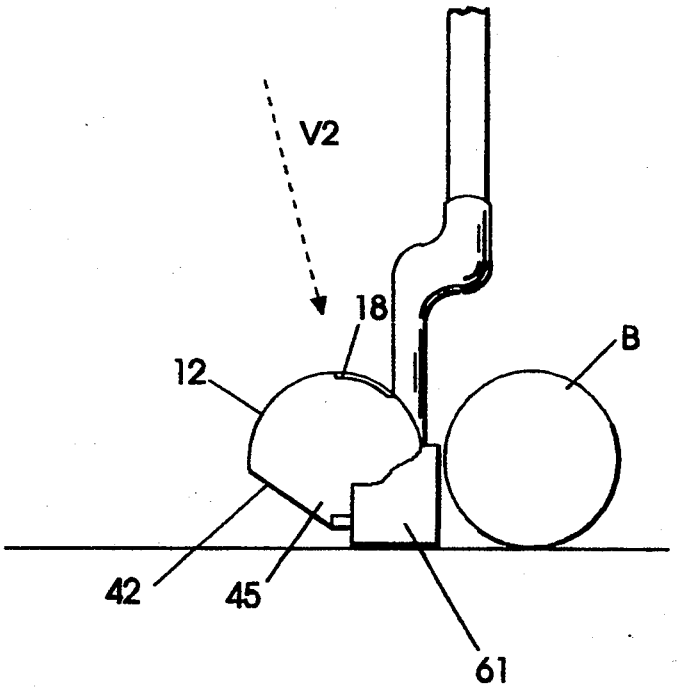
FIG. 9 is a ground level side view of the present invention attached to a heel and toe weighted cavity backed putter when the putter is properly grounded at the position of address behind the ball to be struck.

As shown in FIG. 9, a ground level side view of the proposed invention 12 attached to a heel and toe weighted cavity backed putter head 61 properly grounded at position of address behind the ball B to be struck, the open section 42 serves two additional purposes. When attached to a putter head 61 and the player views the proposed device 12 along line V2 from above the putting line and slightly to the rear of the proposed invention 12, the open section 42 helps maintain the illusion that the device 12 is a sphere rather than a hemisphere with a cylindrical lower half. The open section 42 also eliminates the possibility that the proposed invention 12 will catch the ground while the swing is being executed as would be the case if the bottom half 45 of the proposed invention 12 were a complete cylinder.

It will be understood that various changes may be made in keeping within the scope of the claims of the proposed invention. For example, the bottom of the base may be molded to fit the contours of the tops of putter heads or cavities of putter heads. A notch might be cut out of the front of the proposed invention to accommodate cavity backed putters with "T" shaped alignment means built into the cavity.

What is claimed is:

1. An alignment device for a putter golf club comprising:

a housing having a cylindrical lower half, a base connected to the lower portion of said cylindrical lower half, and a hemispherical upper surface on said cylindrical lower half;

an alignment means for positioning a golfer's eyes over the center of gravity of the putter golf club and slightly behind the putter face, said alignment means comprising a straight leading edge on said base, a reference line on said base perpendicular to said straight leading edge on said base and a slot on said hemispherical upper surface parallel to and positioned above said reference line;

means for detachably securing said housing on a putter golf club.

2. An alignment device for a putter golf club as recited in claim 1 wherein said hemispherical upper surface of said housing is constructed so as to be the size, shape and appearance of a golf ball when viewed from above said housing.

3. An alignment device for a putter golf club as recited in claim 2 wherein said hemispherical upper surface has holes that approximate the size and spacing of dimples that appear on a golf ball.

4. An alignment device for a putter type golf club as recited in claim 1 wherein said housing has a portion of said cylindrical lower half opposite said straight leading edge on said base cut away at an approximate angle of 35 degrees.

5. An alignment device for a putter type golf club as recited in claim 4 wherein said hemispherical upper surface of said housing is constructed so as to be the size, shape and appearance of a golf ball when viewed from above said housing.

6. An alignment device for a putter type golf club as recited in claim 5 wherein said hemispherical upper surface has holes that approximate the size and spacing of dimples that appear on a golf ball.

7. An alignment device for a putter type golf club as recited in claim 3 wherein said housing is detachably secured on a putter golf club by tape with glue on both sides of said tape.

8. An alignment device for a putter type golf club as recited in claim 6 wherein said housing is detachably secured on a putter golf club by tape with glue on both sides of said tape.

9. An alignment device for a putter type golf club as recited in claim 3 wherein said housing is detachably secured on a putter golf club by miniature hooks and eyes.

10. An alignment device for a putter type golf club as recited in claim 6 wherein said housing is detachably secured on a putter golf club by miniature hooks and eyes.

11. An alignment device for a putter type golf club comprising:

a housing having a cylindrical lower half, a base connected to the lower portion of said cylindrical lower half, and a hemispherical upper surface on said cylindrical lower half;

an alignment means for positioning a golfer's eyes over the center of gravity of the putter golf club and slightly behind the putter face, said alignment means comprising a straight leading edge on said base, a reference line on said base perpendicular to said straight leading edge on said base and a slot on said hemispherical upper surface parallel to and positioned above said reference line;

a means for securing said housing to a putter golf club wherein said means comprises pin point holes on said base, a small notch in said base on said straight leading edge aligned with said reference line, and glue for bonding said housing to the putter golf club wherein the bonding is facilitated by said holes in said base and said notch in said straight leading edge.

12. An alignment device for a putter golf club as recited in claim 11 wherein said hemispherical upper surface of said housing is constructed so as to be the size, shape and appearance of a golf ball when viewed from above said housing.

13. An alignment device for a putter golf club as recited in claim 12 wherein said hemispherical upper surface has holes that approximate the size and spacing of dimples that appear on a golf ball.

14. An alignment device for a putter type golf club as recited in claim 11 wherein said housing has a portion of said cylindrical lower half opposite said straight leading edge on said base cut away at an approximate angle of 35 degrees.

15. An alignment device for a putter type golf club as recited in claim 14 wherein said hemispherical upper surface of said housing is constructed so as to be the size, shape and appearance of a golf ball when viewed from above said housing.

16. An alignment device for a putter type golf club as recited in claim 15 wherein said hemispherical upper surface has holes that approximate the size and spacing of dimples that appear on a golf ball.

* * * * *